US005180077A

United States Patent [19]

Lewis

[11] Patent Number: 5,180,077

[45] Date of Patent: Jan. 19, 1993

[54] WATER HEATER BOTTOM INSULATION MEMBER

[75] Inventor: Brian Lewis, Guelph, Canada

[73] Assignee: GSW Inc., Fergus, Canada

[21] Appl. No.: 873,791

[22] Filed: Apr. 27, 1992

[51] Int. Cl.[5] ..... B65D 90/06

[52] U.S. Cl. ..... 220/444; 220/459; 220/611; 220/623; 220/729

[58] Field of Search ..... 220/608, 609, 611, 622, 220/623, 459, 444, 729

[56] References Cited

U.S. PATENT DOCUMENTS

| | | | |
|---|---|---|---|
| 212,484 | 2/1879 | Moseley | 220/622 |
| 475,890 | 5/1892 | Ramsey | 220/622 |
| 2,263,021 | 11/1941 | Uecker | 220/459 |
| 3,009,602 | 11/1961 | Raehs | 220/611 |
| 3,010,602 | 11/1961 | Randolph | 220/459 |
| 3,207,358 | 9/1965 | Fliss | 220/459 |
| 3,360,158 | 12/1967 | Klein | 220/623 |
| 4,010,867 | 3/1977 | Jones | 220/608 |

*Primary Examiner*—Joseph Man-Fu Moy

[57] ABSTRACT

A rigid insulation member fits internally at the bottom end of a water heater having an inner tank with an upwardly concave base and an outer shell separated by an insulation gap from the inner tank. The insulation member has a one piece construction comprising an upwardly convex center portion which mates with the concave base of the inner tank, a peripheral ring which spans the insulation gap and an annular channel between the center portion and the peripheral ring which seats the inner tank of the water heater.

11 Claims, 2 Drawing Sheets

WATER HEATER BOTTOM INSULATION MEMBER

FIELD OF THE INVENTION

The present invention relates to a rigid insulation member to be fitted internally at the bottom of a water heater.

BACKGROUND OF THE INVENTION

Proper insulation in up-to-date water heaters is extremely important to both protect the end user and to reduce heat losses from the water heater. Many different methods have been used to insulate the walls of a water heater. Most of these methods involve the injection of foam material between the inner tank and the outer shell. The foam material, however, does not generally reach the bottom of the water heater resulting in significant heat loss in this area.

Suggestions have been made to provide insulation means, internally of, and at the bottom of the water heater. According to one suggestion the water heater is placed atop a bag-like insulation member which has shape change characteristics to conform to the bottom of the water heater. This type of bag, however, does not guarantee a positive fit to the bottom of the inner tank, and may further provide an improper seat for the tank so that it does not sit perfectly up-right within the water heater.

According to a further suggested design, a rigid insulation member having a u-shape configuration is seated immediately beneath the inner tank with the walls of the insulation member extending upwardly between the tank and the shell. This type of design, however, does not fit with the conventional inner tank design where the base of the tank is upwardly convex, furthermore, the u-shaped rigid insulation member described above may once again not provide a proper seat for the tank where the insulation member, typically made of foam, is relatively thick where it meets the lower tank edge, giving rise to a possible collapse of the foam material with a resultant tilting of the tank within the outer shell.

Presently available water heater insulation members make it very difficult to ground the tank to the shell which is necessary in an electric water heater.

SUMMARY OF THE INVENTION

The present invention provides a rigid insulation member for fitting internally at the bottom end of a water heater where the inner tank has an upwardly concave base and the water heater includes an outer shell separated by an insulation gap from the inner tank. The insulation member itself has a one piece construction comprising an upwardly convex center portion for mating with the concave base of the inner tank, a peripheral ring for spanning the insulation gap and an annual channel between the center portion and the peripheral ring for seating the inner tank such that it sits essentially vertically within the water heater.

BRIEF DESCRIPTION OF THE DRAWINGS

The above as well as other advantages of and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
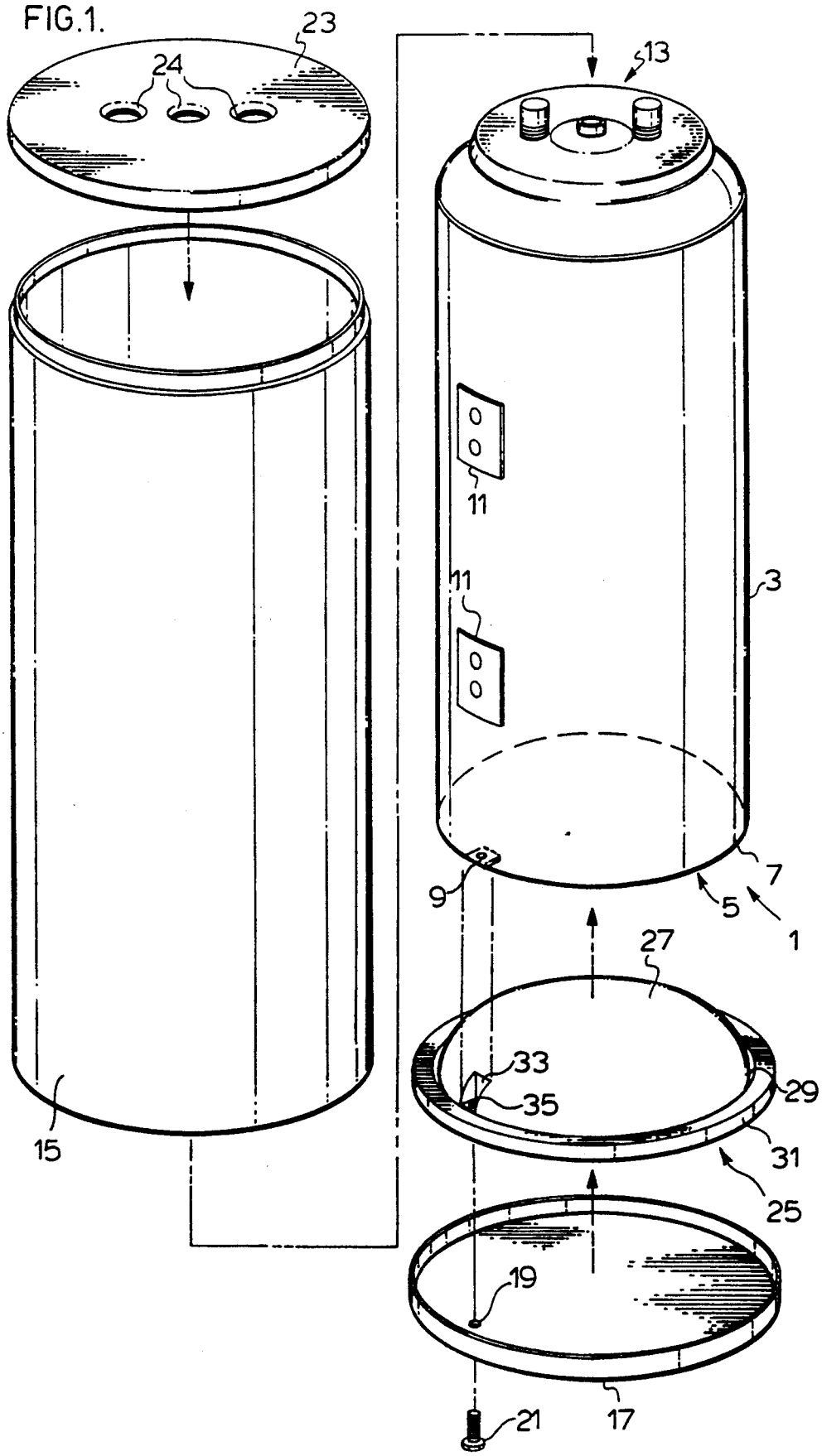
FIG. 1 is an exploded perspective view of a water heater to be fitted with a bottom insulation member according to a preferred embodiment of the present invention.

FIG. 1 shows the overall water heater generally indicated at 1. This water heater comprises an inner tank 3, having an upwardly concave base 5 surrounded by a downwardly extending tank edge or lip 7 which supports the tank internally of the water heater. Tank 3 includes electrical fittings 11 which are used to control temperature of water in the electrically heated tank.

The upper end of tank 3 is provided with typical fittings generally indicated at 13. The bottom end of the tank, is provided with a combination insulation guide and grounding bracket 9 which will be described later in detail.

Tank 3 fits within an outer shell comprising a shell wall 15, a bottom pan 17, and a shell top 23. The Tank 3 fits within an outer shell comprising a shell wall 15, a bottom pan 17, and a shell top 23. The shell top as shown includes a series of openings 24 which align with the fittings 13 at the upper end of the tank. The shell bottom or pan 17 includes an opening 19 for receiving a grounding connector 21 which grounds tank 3 to the outer shell, again to be described later in detail.

Figure 2:
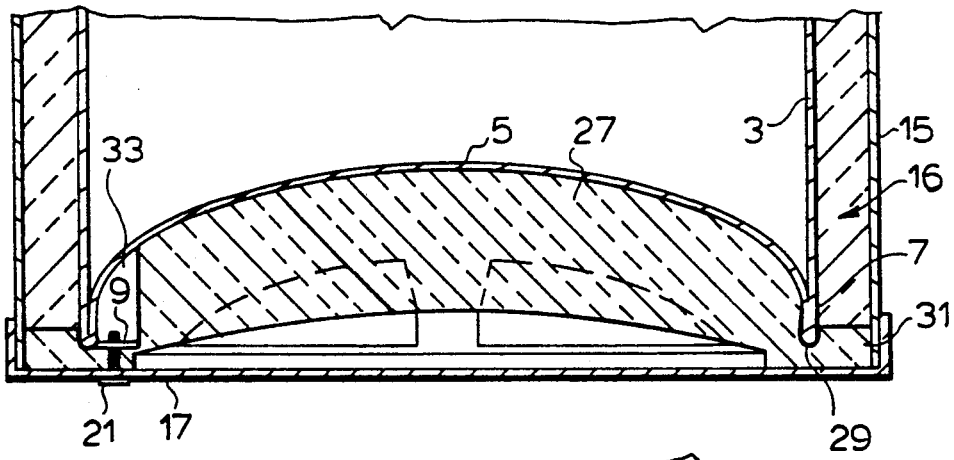
FIG. 2 is a sectional view after assembly of the bottom end of the water heater of FIG. 1.

As best seen in FIG. 2 of the drawings, when the water heater is assembled there is a gap 16 between the tank and the shell. This gap is typically filled with foam insulation material.

The key to the present invention is in the form of a bottom insulation member 25 which fits internally of the water heater, directly beneath the inner tank. Insulation member 25 is molded in a preset configuration of what will be referred to as rigid insulation material, i.e. insulation material which does not change shape as a result of the tank being placed on the insulation member. A product sold under the trade mark STYROPOUR is particularly suitable for forming the insulating member. This particular material has high insulating properties, is light in weight, and is capable of standing extremely high pressures without crushing of the material. This latter feature is very important since the weight of the inner tank is supported by the insulation member in a manner to maintain the tank upright, or at least essentially upright within the water heater.

It is, however, to be appreciated that other types of materials and in a particular expanded foam materials can be used in forming the insulating member.

The insulating member 25 is molded to provide its accurate preset configuration. This configuration includes a center upwardly convex portion 27, a peripheral ring or ledge 31, and an annular channel 29 between ring 31 and center portion 27. The annular channel does not completely penetrate the insulation member so that it has a one piece construction.

Insulation member 25 further includes a recess 33 downwardly through center portion 27 adjacent annular channel 29. Opening 35 is located at the bottom of recess 33.

Figure 3:
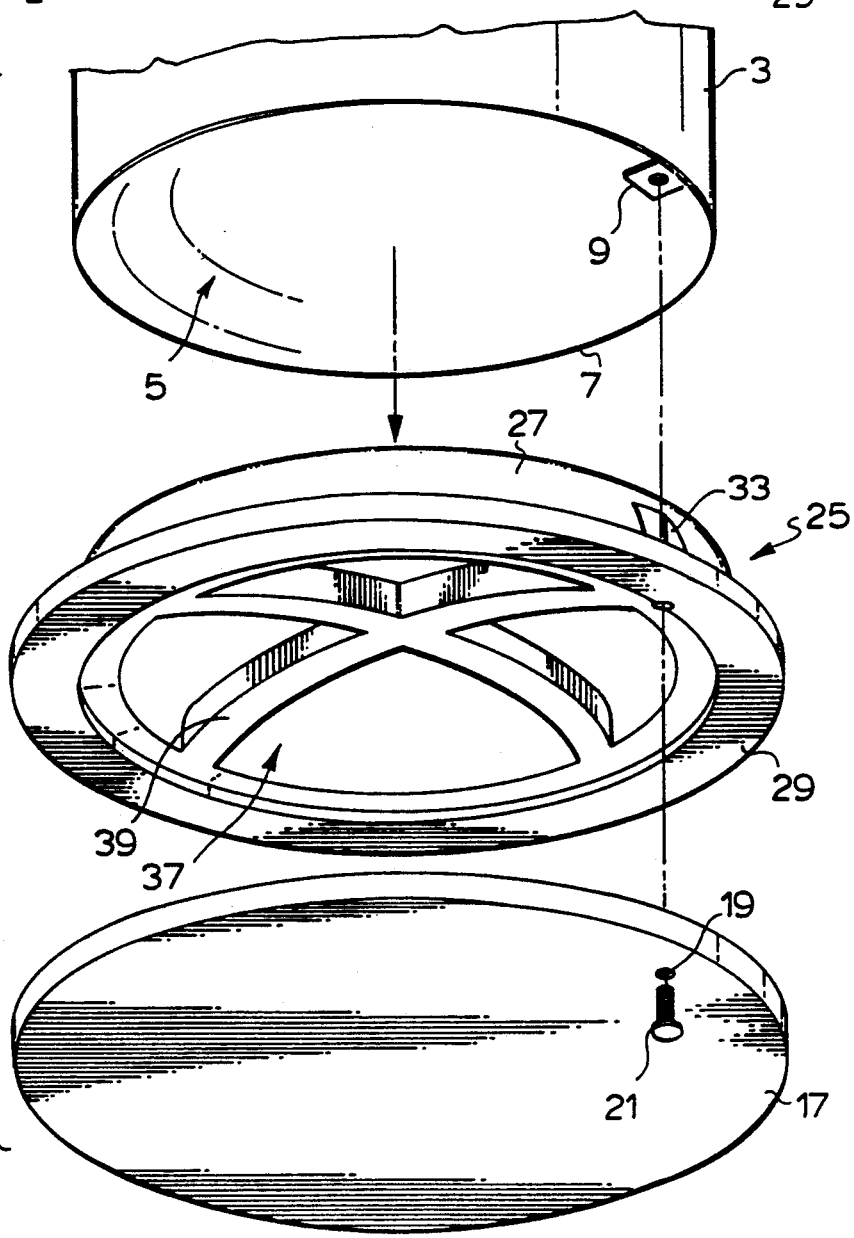
FIG. 3 is a further exploded bottom perspective view of the water heater of FIG. 1.

When the overall water heater is assembled insulation member 25 is located immediately beneath tank 3 as best seen in FIGS. 2 and 3 of the drawings. As earlier described, the tank has an upwardly concave base 5 which causes any sediment within the tank to collect around the edge of the tank where it generally will not be drawn up with water taken from the tank.

The center portion 27 of insert 25 mates flushly with the concave base 5 of the tank and the downwardly extending bottom edge or lip 7 of the tank seats within annular recess 29 of the insulation member. As earlier noted the particular material chosen for the insulation member resists crushing to maintain the tank in an upright position, furthermore, because the material in the insulation member at the channel is very thin, there is very little travel at the bottom of the tank even if it should crush the insulation member.

The annular channel 29 adds the further benefit that it provides an extremely accurate centering of the insulation member relative to the tank.

When the tank is properly seated in channel 29, ring 31 of the insulation member spans the insulation gap between the tank and the outer shell. This again, provides a very positive locater for the insulation member within the water heater. It also assists in blocking the escape of foam past the insulation member at the bottom of the tank.

Shell bottom 17 fits outwardly over the shell wall 15 as shown. The tank is then grounded to the shell bottom by fitting ground member 21 which is in the form of a threaded bolt upwardly through opening 19 in the shell bottom. Opening 19 is aligned with opening 35 which is in turn aligned with a threaded bore provided in grounding bracket 9, as best seen in FIG. 3 of the drawings. The bolt threads into the bore in the bracket connecting and grounding the tank to the shell.

The proper positioning of insulation member 25 at the bottom of the inner tank to assure the alignment of the openings as described immediately above, is provided as a result of recess 33 which receives bracket 9 as a guide between the insulation member and the bottom of the water heater tank.

In molding insulation member 25, it is provided with a hollow region generally indicated at 37 immediately below the upwardly convex center portion 27. The insulation member is also ribbed as indicated at 39 for maximizing strength without adding to the bulk of the insulation member. The center portion as shown, although rising well above peripheral ring 25 is of substantially the same thickness as the peripheral ring, so that there is a generally uniform cooling of the molded material. This ensures common structural characteristics throughout the molded insulation member.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A rigid insulation member made from a heat insulating material for fitting internally at the bottom end of a water heater having an inner tank with an upwardly concave base and an outer shell separated by an insulation gap from said inner tank, said insulation member having a one piece construction comprising an upwardly convex center portion for mating with the concave base of the inner tank, a peripheral ring for spanning the insulation gap and an annular channel between said center portion and said peripheral ring for seating the inner tank of the water heater.

2. An insulation member as claimed in claim 1 having a ground member receiving opening therethrough adjacent said annular channel in said center portion of said insulation member.

3. An insulation member as claimed in claim 2 including a tank guide recess in said center portion, ground member receiving opening being located at said recess.

4. An insulation member as claimed in claim 3 including a hollow region beneath said center portion and wherein said peripheral ring is decreased in height relative to said center portion whereby said insulation member has a generally uniform thickness at said center portion and said peripheral ring.

5. A water heater comprising an outer shell including a shell wall and a shell bottom, an inner tank having a lower supporting edge and an upwardly concave base surrounded by said supporting edge, said inner tank being radially spaced from said shell wall by an insulation gap, and a bottom insulation member internally of said water heater, said insulation member comprising a body of rigid insulation material formed with an upwardly convex center portion mating with said concave base of said inner tank, a peripheral ring spanning said insulation gap and an annular channel between said peripheral ring and said center portion, said lower supporting edge of said inner tank being seated in said annular channel of said insulation member above said shell bottom of said outer shell.

6. A water heater as claimed in claim 5 including a ground member between said shell bottom and said tank fitted through a ground member opening in said insulation member.

7. A water heater as claimed in claim 6 wherein said tank includes an insulation member guide and said insulation member includes a guide recess in which said guide is fitted for positioning of said insulation member such that said ground member opening is properly aligned to pass said ground member through said insulation member from said shell bottom to said tank.

8. A water heater as claimed in claim 7 wherein said guide comprises a bracket extending radially inwardly from said lower supporting edge of said inner tank and includes a bore in which said ground member is threaded, said ground member opening being located in said guide recess of said insulation member.

9. A rigid insulation member made from a heat insulating material for fitting internally at the bottom end of a water heater having an inner tank with an upwardly concave base and an outer shell separated by an insulation gap from said inner tank, said insulation member having a one piece construction comprising a tall centre portion for fitting up into the concave base of the inner tank, a peripheral ring for spanning the insulation gap and an annular channel between said centre portion and said peripheral ring for seating the inner tank of the water heater.

10. A rigid insulation member as claimed in claim 1 made from a molded foam material.

11. A rigid insulation member as claimed in claim 1 wherein said peripheral ring extends radially outwardly from said annular channel.

* * * * *